US005200725A

United States Patent [19]

Arnold et al.

[11] Patent Number: 5,200,725

[45] Date of Patent: Apr. 6, 1993

[54] MOLDED CASE CIRCUIT BREAKER MULTI-POLE CROSSBAR ASSEMBLY

[75] Inventors: David Arnold, Chester; Roger N. Castonguay, Terryville, both of Conn.

[73] Assignee: General Electric Company, New York, N.Y.

[21] Appl. No.: 644,185

[22] Filed: Jan. 22, 1991

[51] Int. Cl.[5] ..... H01H 9/00

[52] U.S. Cl. ..... 335/172; 335/21; 335/10

[58] Field of Search ..... 335/21-24, 335/167-176, 6-10

[56] References Cited

U.S. PATENT DOCUMENTS 4,149,129 4/1979 Andersen et al. ..... 335/21

4,835,842 6/1989 Castonguay et al. ..... 335/167

*Primary Examiner*—Lincoln Donovan

*Attorney, Agent, or Firm*—Richard A. Menelly

[57] ABSTRACT

A modular crossbar arrangement for molded case circuit breakers allows a plurality of contact arm assemblies to be interconnected from a single modular unit. To provide increased acceleration to the movable contact arms a contact arm accelerator lever interfaces with the contact arm and crossbar assembly. To promote further acceleration of the movable contact arms to their closed positions, the movable contact arms in a multi-pole circuit breaker are staggered with respect to their rotational alignment within each pole on the crossbar assembly.

6 Claims, 6 Drawing Sheets

MOLDED CASE CIRCUIT BREAKER MULTI-POLE CROSSBAR ASSEMBLY

BACKGROUND OF THE INVENTION

Multi-phase industrial electrical power distribution systems are protected against damage from overcurrent circuit conditions by corresponding multi-pole circuit breakers wherein each phase of the power distribution circuit is directed through a separate pole within the circuit breaker assembly.

One of the problems encountered in the design and manufacture of a multi-pole circuit breaker is the provision of a pair of operating springs of sufficient strength to open and close each pole simultaneously when turning the circuit breaker contacts between their open and closed position. U.S. Pat. No. 4,090,157 entitled "Operating Handle Means for Stacked Circuit Breaker Modules" proposes the use of a separate operating spring within each separate pole of a multi-pole circuit breaker arrangement. U.S. Pat. No. 4,736,174 describes a pair of operating springs used within the center pole of a three-pole circuit breaker to separate the circuit breaker contacts within each individual pole during overcurrent conditions as well during manual opening and closing of the circuit breaker contacts.

In some industrial electrical power distribution systems, four-pole circuit breakers are installed to protect the electrical circuit as well as the associated industrial equipment. The movable contact arms which carry the movable contacts within the separate poles are, in turn, carried by a common unitary crossbar assembly. The provision of such a four-pole circuit breaker requires a unitary crossbar assembly of increased length. The addition of a fourth pole to a standard three-pole circuit breaker design increases the static coefficients of friction associated with the pivot pins that rotatably carry the movable contact arms and hence requires larger operating springs to overcome the increased friction.

It would be economically advantageous to provide a four-pole circuit breaker capable of separating the contacts within the separate poles without requiring a larger pair of operating springs than a three-pole circuit breaker or a longer crossbar assembly. It would be further advantageous to provide a modular crossbar unit that could be additively combined to form multi-pole circuit breakers without requiring a separate crossbar assembly for each multi-pole design.

One purpose of the invention is to provide a modular crossbar arrangement whereby a plurality of circuit breaker poles can be fabricated from a common modular crossbar unit.

A further purpose of the invention is to provide a contact arm accelerator lever to increase the closing force applied to the movable contact arms within a standard multi-pole circuit breaker design.

An additional purpose of the invention is to provide means for decreasing the effects of friction on the movable contact arms in existing multi-pole circuit breaker designs.

SUMMARY OF THE INVENTION

A modular crossbar configuration allows a plurality of multi-pole circuit breaker crossbar configurations to be fabricated from a plurality of unitary modular units. A contact arm accelerator lever attached to the circuit breaker operating mechanism delays the action of the operating springs until the springs have achieved maximum elongation. Staggering the closing sequence of the movable contact arms within the individual poles of the multi-pole circuit breaker substantially reduces the effects of friction during the contact closing operation.

DESCRIPTION OF THE PREFERRED EMBODIMENT

Figure 1:
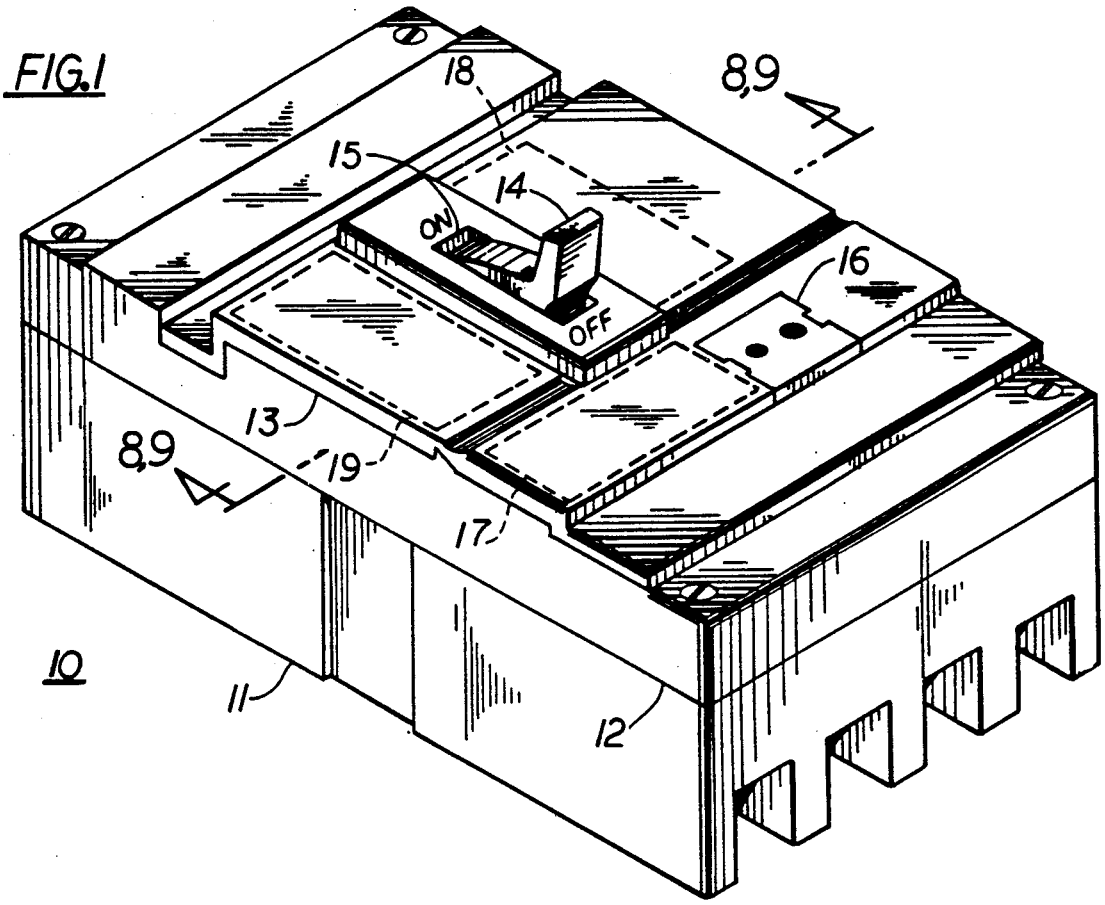
FIG. 1 is a top perspective view of a molded case four-pole circuit breaker employing the modular crossbar configuration and contact arm accelerator lever in accordance with the invention.

A four-pole electronic circuit breaker 10 as shown in FIG. 1 includes a molded plastic case 11 to which a molded plastic cover 12 is attached along with an accessory cover 13. A circuit breaker operating handle 14 extends through a slot 15 formed in the circuit breaker cover for manual intervention to turn the circuit breaker between its "ON" and "OFF" conditions. A rating plug 16 which is described within U.S. Pat. No. 4,649,455, interconnects with the electronic trip unit printed wiring board 17, such as described in U.S. Pat. No. 4,589,052. The actuator unit 18 which is described within U.S. Pat. No. 4,806,893 is contained within the circuit breaker cover 12 under the accessory cover 13. An auxiliary switch unit 19 such as described within U.S. Pat. No. 4,794,356 is contained within the circuit breaker cover under the accessory cover and on the opposite side of the circuit breaker operating handle 14.

Figure 2:
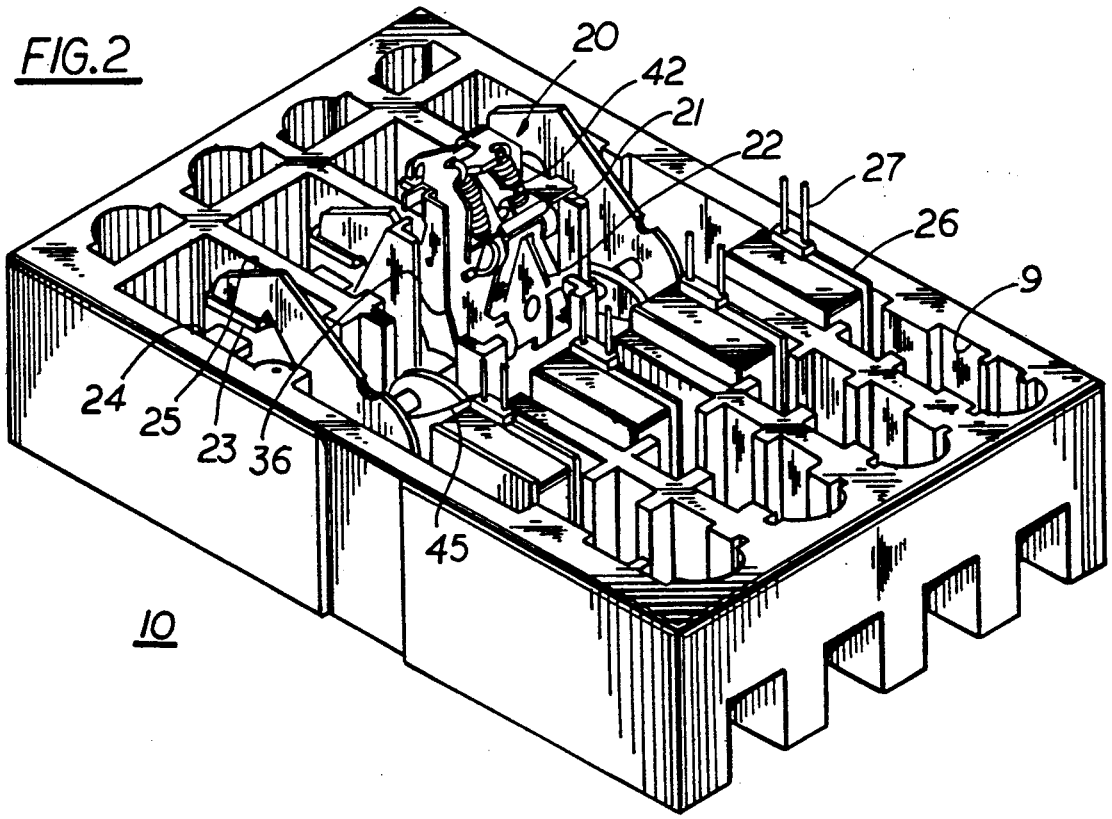
FIG. 2 is a top perspective view of the circuit breaker of FIG. 1 with the cover removed to depict the circuit breaker operating mechanism assembly.

In operation, the circuit current is sensed within three current transformers 26, shown in the circuit breaker 10 depicted in FIG. 2, which connect with the trip unit printed wire board by means of pin connectors 27. The circuit current is processed within the trip unit contained within the printed wire board and the operating mechanism 20 becomes articulated to interrupt the circuit current when the circuit current exceeds predetermined levels for predetermined time periods. The actuator interacts with the operating mechanism upon displacement of the trip bar 21 and the attached latch assembly 22 thereby releasing the powerful operating mechanism springs 42, which in turn, drive the movable contact arms 25 on the crossbar assembly 45 to the open position breaking electrical contact between the movable contacts 23 and the fixed contacts 24 to rapidly interrupt the circuit current. As described earlier, a separate movable contact arm is contained within a separate compartment as indicated at 9 for each pole of the circuit breaker. An accelerator lever 36 provides delayed motion to the crossbar 45 to provide increased closing force to the movable contact arms in the manner to be described below in greater detail.

Figure 3:
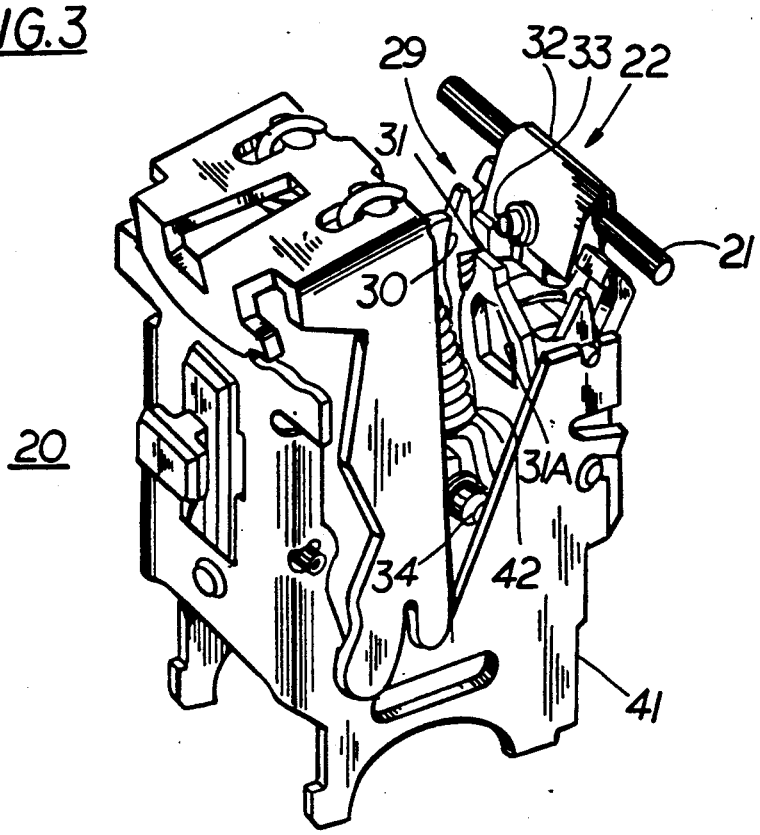
FIG. 3 is an enlarged top perspective view of the circuit breaker operating mechanism depicted in FIG. 2.

The operating mechanism 20 and latch assembly 22 are depicted in FIG. 3. The operating mechanism 20 is supported within a wrap-around continuous side frame 41 that supports the powerful operating springs 42. The cradle assembly 29 interacts with the primary latch 31 wherein the opening 31A is defined for retaining the cradle hood 30 at the end of the cradle assembly 29. The trip bar 21, is carried by the secondary latch 32 which includes the secondary latch pin 33. To promote the rapid latching and release of the secondary latch before and after contact by the trip bar 21, the unitary die-cast piece that includes the trip bar and the secondary latch is nickel-plated. The nickel coating also prevents the die-cast material from corroding under long periods of extended use. The operating mechanism connects with the movable contact arm and crossbar by means of the roller pin 34.

Figure 4:
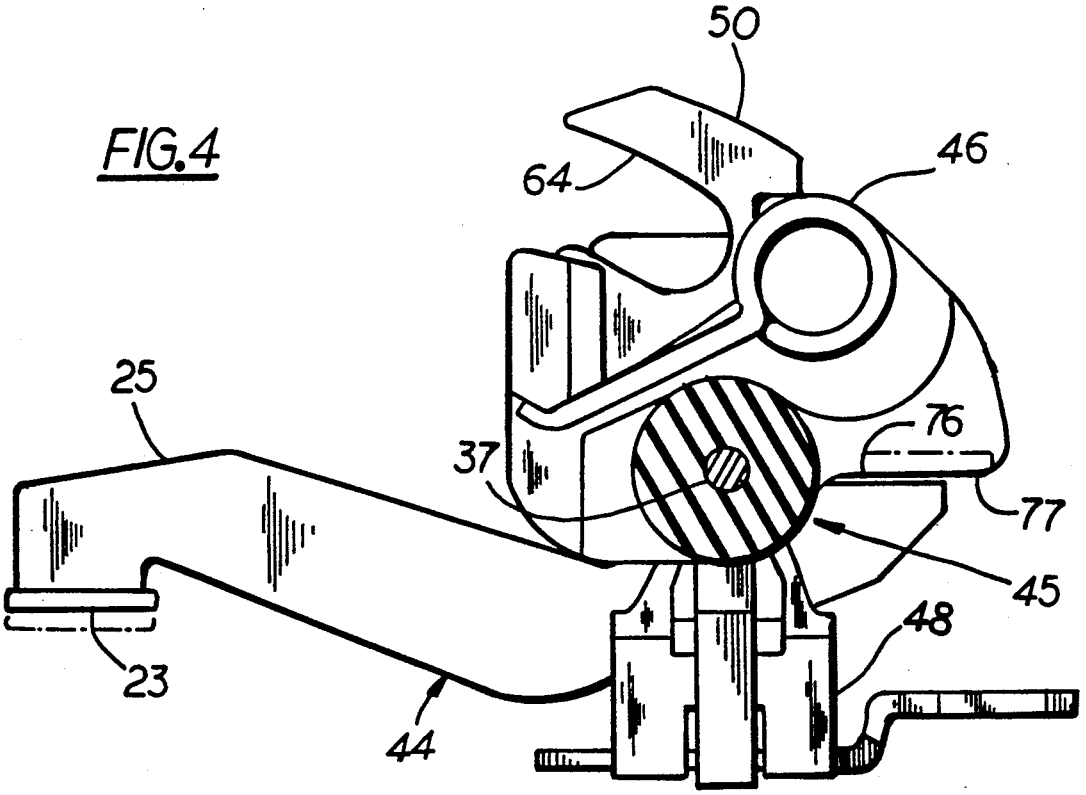
FIG. 4 is an enlarged side view in partial section of the crossbar and movable contact arm of FIG. 4.

A movable contact arm assembly 44 is shown in FIG. 4 attached to the crossbar assembly 45. The movable contact arm assembly includes the movable contact arm 25 and the movable contact 23. The movable contact arm is pivotally attached to the movable contact arm support 48 by connection with the crossbar assembly through the pivot pin 37. The crossbar assembly 45 as described in aforementioned U.S. Pat. Nos. 4,733,211 and 4,782,583 includes a contact spring 46 to hold the movable contact 23 in good electrical contact with the fixed contact 24 (FIG. 2) during quiescent current conditions. The cam member 50 on the crossbar assembly interconnects the crossbar assembly with the operating mechanism assembly 20 (FIG. 3) by capturing the roller pin 34 shown pivotally supported at the ends of the operating springs 42 within the curved slot 64. The end 76 of the movable contact arm 25 interact with the crossbar assembly 45 by contacting the bottom surface 77 of the crossbar as indicated.

Figure 5:
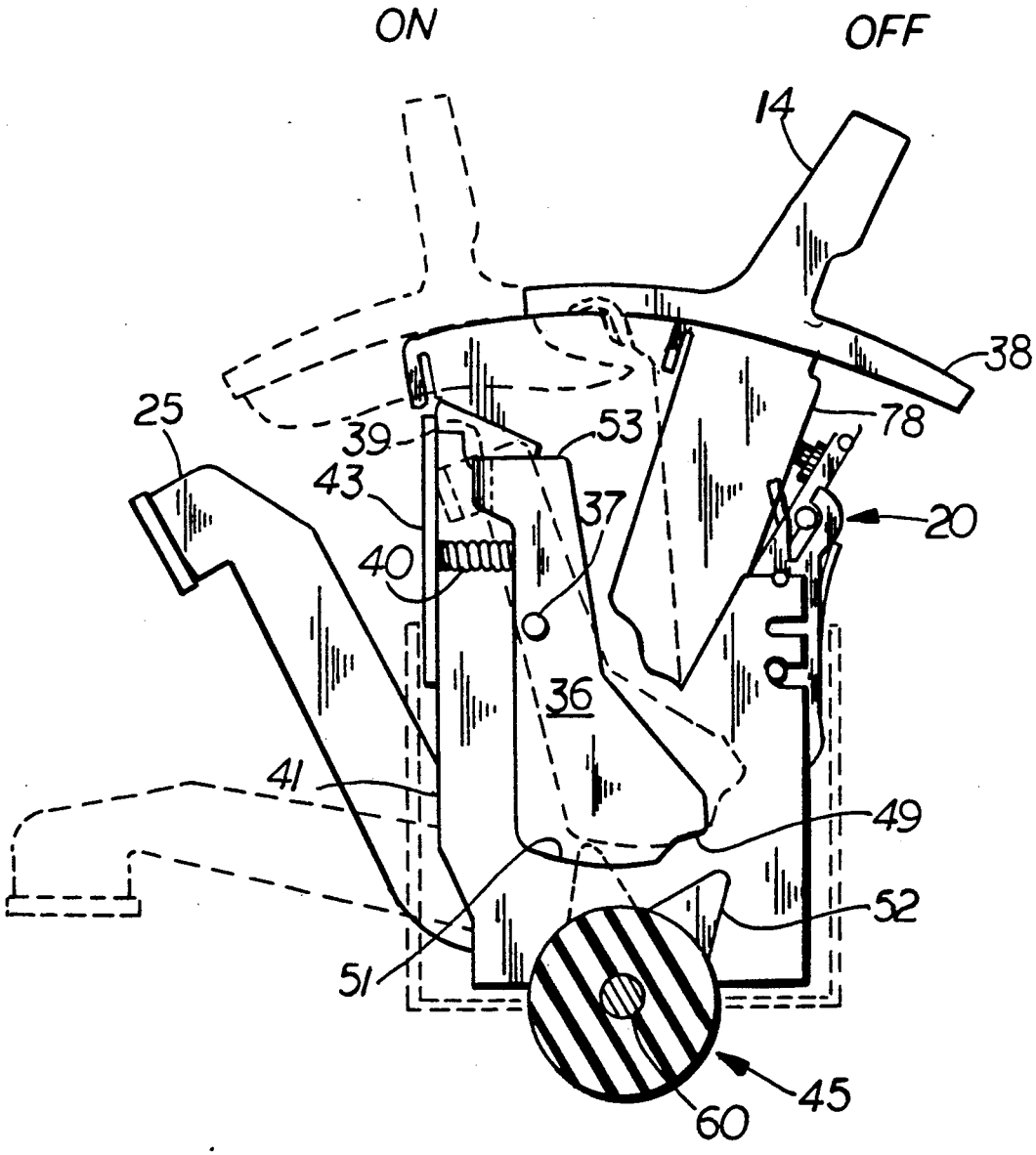
FIG. 5 is an enlarged side view of the operating mechanism of FIG. 3 with the accelerator lever of the invention attached to the operating mechanism side frame.

The fourth pole in the circuit breaker 10 depicted in FIGS. 1 and 2, provides additional strain to the operating mechanism springs which were originally designed for use within three pole circuit breakers as described within the aforementioned U.S. Pat. Nos. 4,733,211 and 4,782,583, for example. In moving the operating handle 14 and the associated movable contact arms 25 from the "OFF" position as indicated in solid lines in FIG. 5 to the "ON" condition indicated in phantom, the operating springs must overcome the static coefficient of friction exerted upon the contact arm pivot pin 60 extending form the crossbar assembly 45. Since a separate pair of pivot pins are used for each individual movable contact arm within the separate poles, the static coefficients of friction for the individual pivot pins are cumulative. It has been determined, that when the operating springs are fully stretched to their maximum elongation before the movable contact arm is driven to its closed position, the energy transfer from the extended operating springs to the movable contact arms is at a maximum value. The movable contact arms accelerator lever 36, hereafter "accelerator lever" is used to delay the movement of the movable contact arms 25 until the operating springs are stretched to their maximum elongation. The accelerator lever is pivotally attached to the operating mechanism side frame 41 by means of a pivot pin 37 and is biased against the front 43 of the side frame by means of a tab 39 at the to extension 53 of the accelerator lever and a small compression spring 40. A bottom extension 51 at the opposite end of the accelerator lever interacts with the crossbar assembly 45 by means of the step 49 formed on the bottom extension of the accelerator lever and the lobe 52 which projects from the top of the crossbar assembly. When the operating handle 14 is moved from its "OFF" to its "ON" position to overcenter the operating springs and drive the movable contact arms 25 via the crossbar assembly 45 to their closed position, the accelerator lever 36 temporarily deters the crossbar assembly 45 from rotating in the counterclockwise direction in the following manner. As the operating handle 14, which connects with the operating mechanism 20 by means of the handle skirt 38 and handle yoke 78, begins to rotate the crossbar assembly 45 in the counterclockwise direction, the lobe 52 on the crossbar assembly contacts the step 49 on the accelerator lever and prevents further rotation of crossbar assembly rotation until the lobe 52 clears the step 49. The delayed motion of the crossbar assembly allows the operating springs to become stretched to their maximum elongation such that when the crossbar assembly is free of the accelerator lever, the elongated operating springs snappingly drive the movable contact arms 25 to the closed position indicated in phantom. Continued rotation of the operating handle brings the handle yoke 78 into contact with the tab 39 on the accelerator lever and then rotates the lobe 52 free of the step 49. The lobe 52 now engages the surface of the bottom extension 51 until the movable contact arms 25 return to their open position as indicated in solid lines. This allows the charged compression spring 40 between the accelerator lever and the front of the side frame to rotate the accelerator lever clockwise back to its initial position indicated in solid lines. This resets the accelerator lever so that the lobe 52 on the crossbar assembly will contact the step 49 on the accelerator lever when the circuit breaker operating handle 14 is again moved from the "OFF" to the "ON" position.

Figure 6:
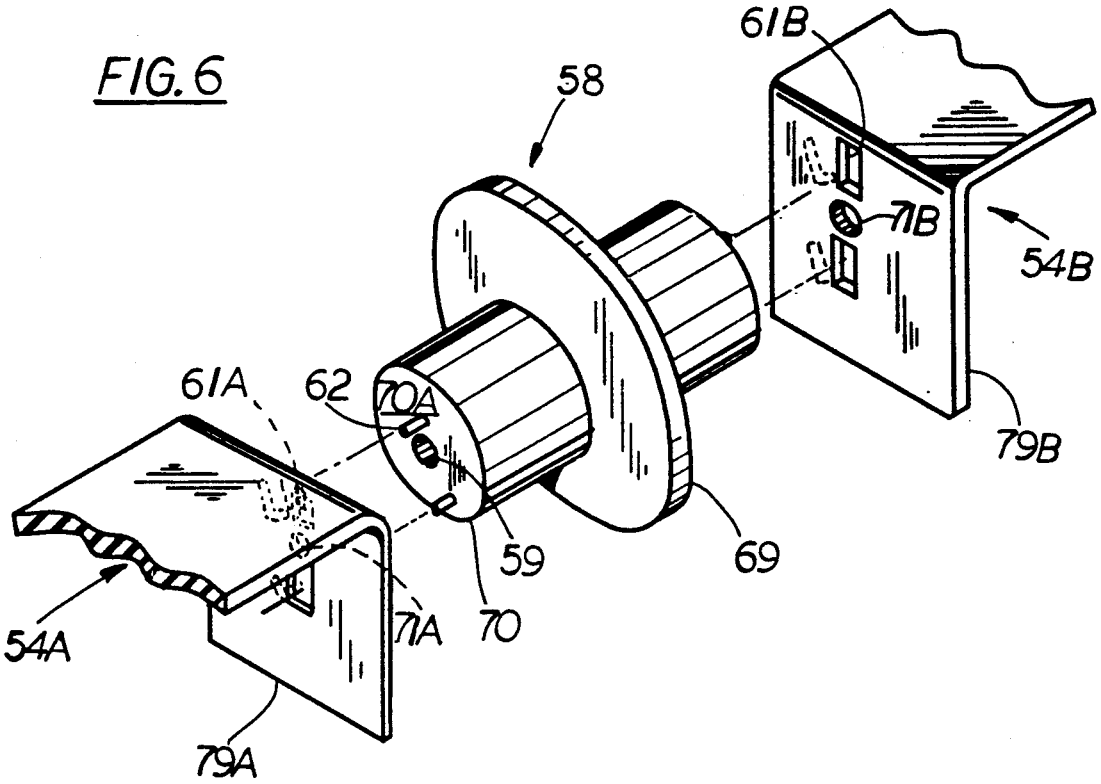
FIG. 6 is an enlarged top perspective view of the modular crossbar unit of the invention prior to assembly.

In fabricating the crossbar assembly 45 depicted earlier in FIG. 4, a modular crossbar coupler unit 58, hereafter "coupler" is used to interconnect between adjoining pairs of movable contact arms supports, such as indicated at 54A, 54B in FIG. 6. Each coupler comprises a molded plastic inner baffle 69 having a pair of outer cylinders 70, integrally-formed therewith. The steel interlock pins 62 extending from the surface 70A of the cylinders pass through the corresponding pair of rectangular slots 61A, 61B formed within the side arms 79A, 79B of the movable contact arms supports 54A, 54B. The openings 59 formed within the ends of the outer cylinders of the coupler aligns with the corresponding thru-holes 71A, 71B in the opposing side arms to receive and support the contact arm pivot pin 60 shown earlier in FIG. 5.

Figure 7:
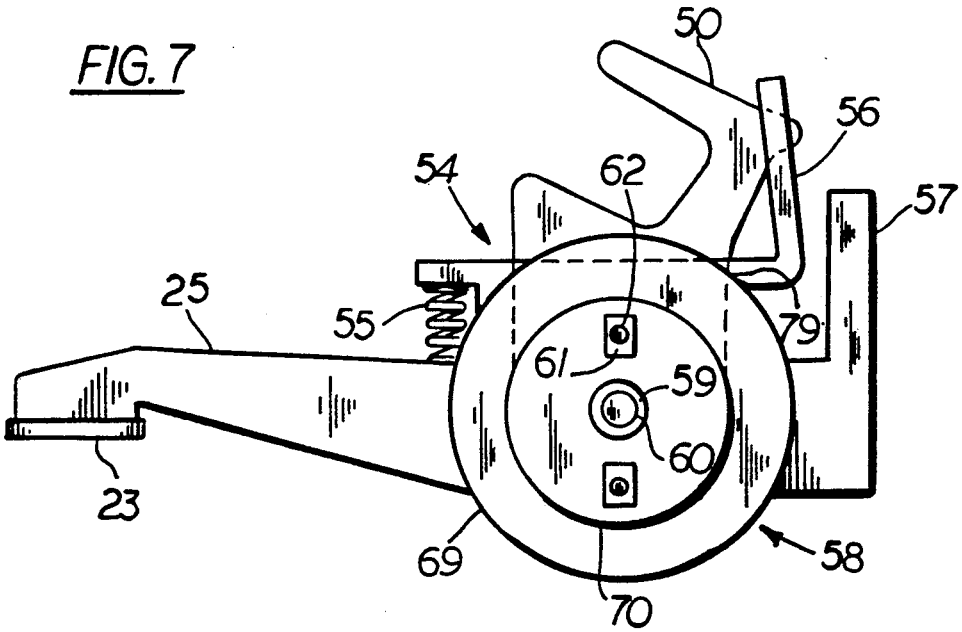
FIG. 7 is an enlarged side view of the modular crossbar unit of FIG. 7 after assembly to the movable contact arm assembly.

The attachment between the coupler 58 and one of the movable contact arm supports 54 is best seen by referring now to FIG. 7. The supports comprise a pair of side arms 79 only one of which is shown along with an L-shaped cross piece 56 which extends across the side arms and is apertured to receive the slotted cam member 50. The contact spring 55 extending between the movable contact arm 25 and the bottom surface of the L-shaped cross piece 56 serves to hold the movable contact 23 in its closed position under quiescent operating conditions while allowing the movable contact arm 25 to rotate independently from the coupler 58 when electrodynamically blown to its open position upon the occurrence of a short circuit fault. The extension 57 at the end of the movable contact arm opposite the movable contact 23 is adapted for electrical connection with the electrical braid conductor (not shown). The inner baffle 69 provides electrical isolation between the individual movable contact arms 25 that are situated within the separate compartments 9 (FIG. 2) and which comprise the separate poles of the four-pole circuit breaker depicted in FIGS. 1 and 2.

Referring back to FIG. 7, it is noted that the side arms 79 of the movable contact arm support 54 are attached to the coupler 58 by the extension of the interlock pins 62 from the outer cylinders 70 through the rectangular slots 61 that are formed within the side arms and by the insertion of the pivot pin 60 within the thru-hole 59. The coupler 58 differs from the earlier crossbar assembly 45 shown in FIG. 4 which included a separate cross-over contact spring 46 and which interacted with the movable contact arms 25 by contact between the end 76 of the movable contact arm and the bottom surface of the crossbar as described earlier. The provision of the coupler 58 in combination with the movable contact arm supports 54 allows a two-pole, three-pole and four-pole circuit breaker crossbar assembly to be formed by the additive combination of corresponding supports and coupler units.

Figure 8:
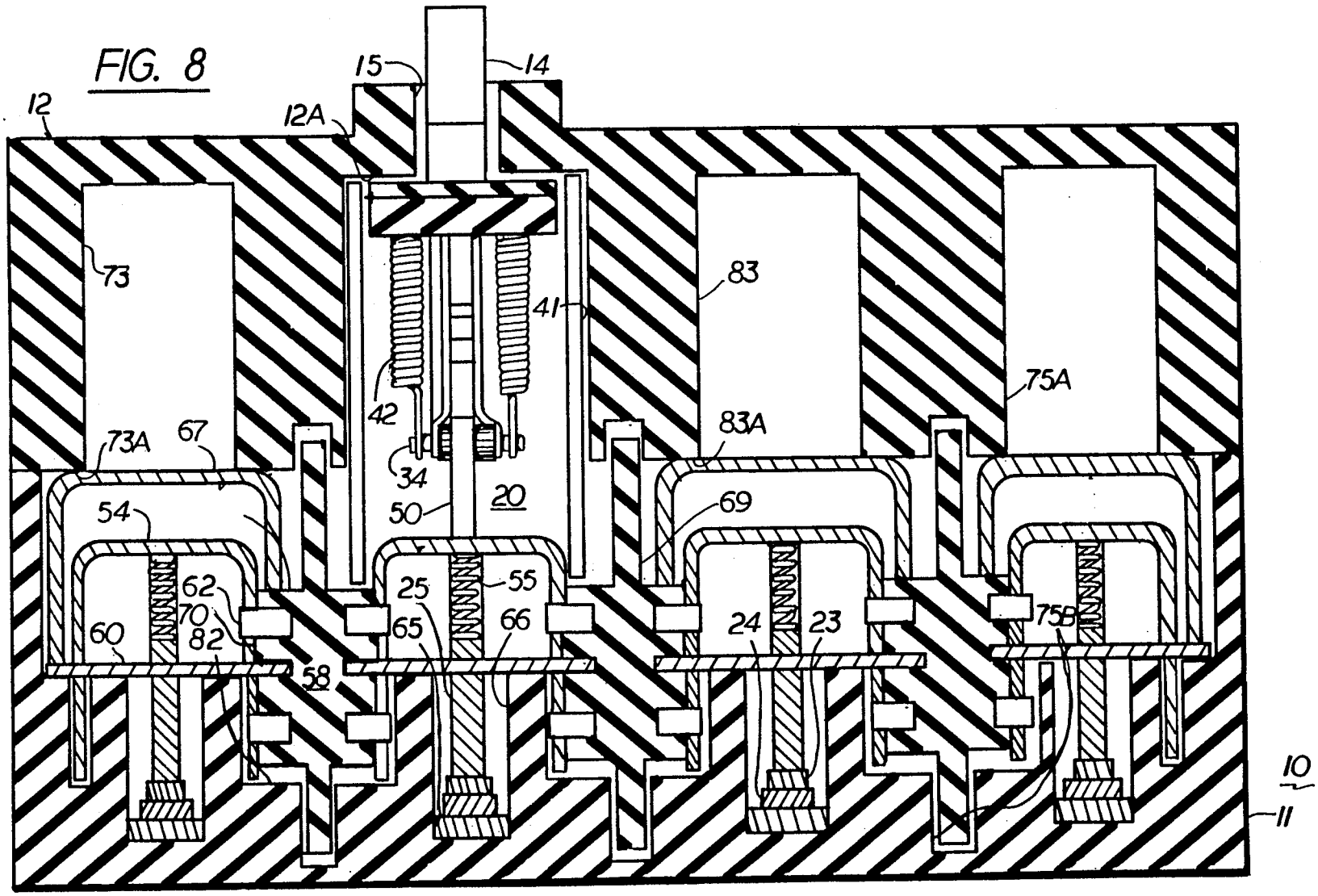
FIG. 8 is an enlarged front section view of the multi-pole circuit breaker of FIG. 1 depicting assembly of the modular crossbar unit shown in FIG. 6.

One such four-pole circuit breaker 10 including three coupler units 58 is depicted in FIG. 8. The operating handle 14 extends through the handle slot 15 formed in the circuit breaker cover 12 and interfaces with the operating mechanism 20 by means of the handle yoke in the manner described earlier. The movable contact arms 25 that carry the movable contacts 23 in and out of contact with the fixed contacts 24 interconnect with the operating mechanism 20 by means of the cam member 50 on the movable contact arm supports 54 and the roller pin 34 arranged at the end of the operating springs 42. The movable contact arm supports 54 are interconnected with the intervening couplers 58 by the interlock pins 62 and the contact arm pivot pins 60. The movable contact arm supports 54, the fixed contacts 24 and the fixed contact supports 65 are positioned within recesses 66 formed in the circuit breaker case 11. The contact springs 55 arranged under the movable contact arm supports 54 force the associated movable contact arms 25 and attached movable contacts 23 in tight abutment with the fixed contacts 24. The couplers 58 are held tightly within recesses 82 formed in the circuit breaker case by contacting the top surfaces 70A of the outer cylinders 70 with one end of the side frame 41 of the operating mechanism 20 and trapping the top of the side frame under the bottom surface 12A of the circuit breaker cover. The couplers 58 are also supported within the circuit breaker case by means of U-shaped brackets 67 that are trapped under the cover side walls 73 as indicated at 73A and under the cover inner walls 83 as indicated at 83A. The inner baffles 69 on each of the couplers 58 rotate within corresponding recesses 75A, 75B formed within the circuit breaker cover 12 and case 11 while maintaining electrical isolation between the movable contact arms 25 located within the different compartments.

Figure 9:
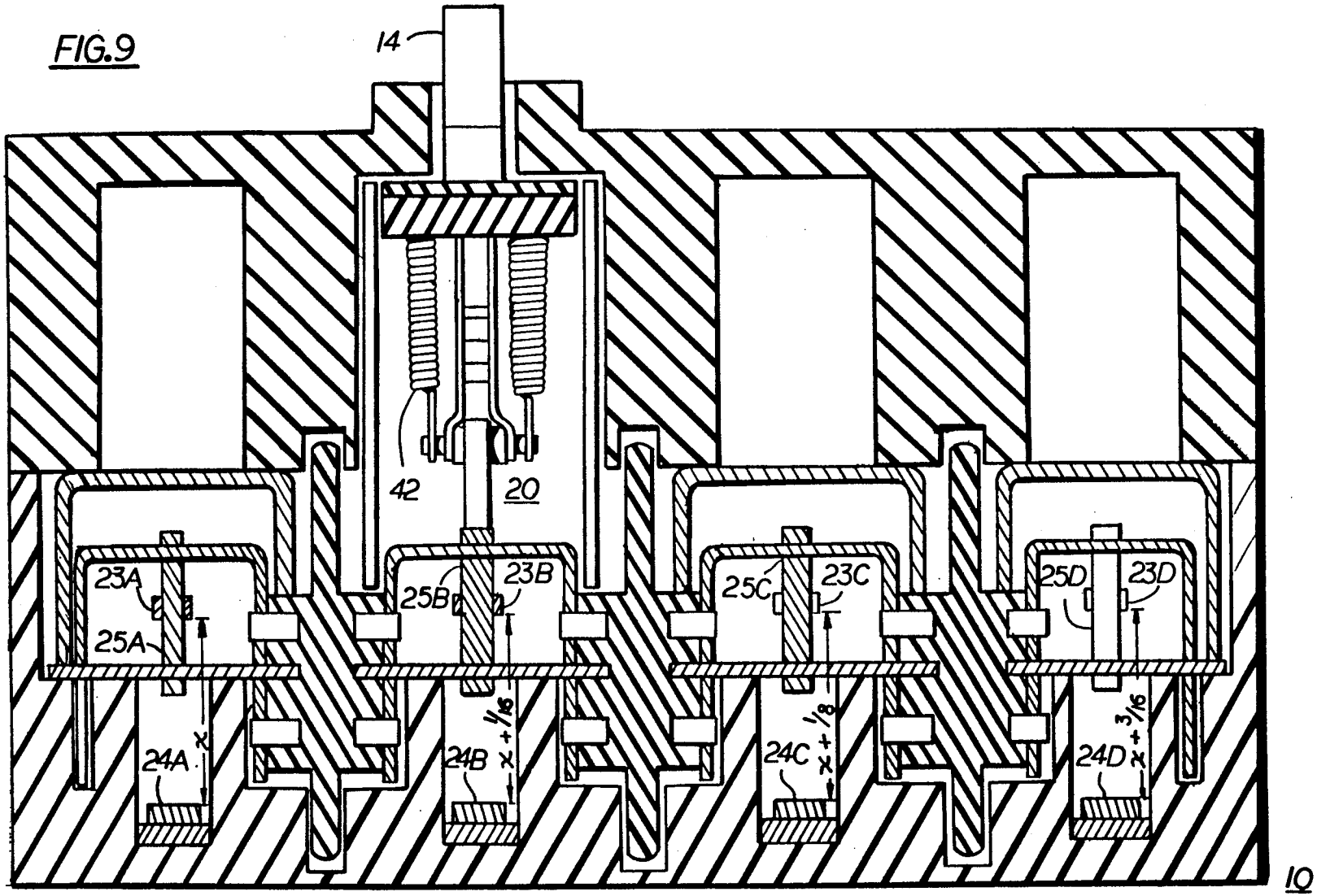
FIG. 9 is an enlarged front sectional view of the multi-pole circuit breaker of FIG. 1 depicting the movable contact arms within the separate poles displaced by a predetermined increment.

An approach to increasing the contact-closing efficiency of the circuit breaker operating springs 42 can be seen by referring now to the circuit breaker 10 depicted in FIG. 9. As described earlier the movable contact arm pivots 60 accumulatively contribute to the static coefficient of friction that must be overcome when the circuit breaker operating handle 14 rotates the operating mechanism 20 to drive the movable contact arms 25A–25D to their closed positions. It is known that the dynamic coefficient of friction is substantially less than the static coefficient for the movable contact arm pivots. Accordingly, it would be mechanically advantageous to decrease the combined static friction that must be overcome immediately prior to the contact closing operations. This is accomplished by staggering the separation distance between the movable contacts 23A–23D and the fixed contacts 24A–24D when the movable contact arms are in the open position to allow the movable contact arms to move sequentially in time rather than simultaneously. For a separation distance x between the movable contact 23A and fixed contact 24A in the A-pole, the contact separation distances are offset by an increment of 1/16" for example, for the remaining three-poles (B–D). The 1/16" increment ensures that the movable contact 23A in the A-pole as viewed from the left of FIG. 9, strikes the associated fixed contact 24A in the A-pole before the movable contacts (23B–23D) in the (B–D)-poles strike their respective fixed contacts (24B–24D) and hence there is a sequential transfer from static to dynamic conditions. By the time the movable contact 23D within the D-pole strikes its associated fixed contact 24D, the other movable contacts (23A–23C) within the other three-poles (A–C) have already struck their associated fixed contacts (24A–24D) and hence the operating mechanism only has to overcome the static coefficient of friction in one pole at any give instant during the contact closing operation.

The transfer of the friction from static to dynamic conditions accordingly decreases the friction generated by the pivot pins 60 shown earlier in FIG. 7. Referring now to FIG. 6, the "staggering" of closing of the circuit breaker contacts can conveniently be accomplished by varying the position of the interlock pins 62 as shown in phantom in FIG. 6 for each different pole and the position of the rectangular slots 61A, 61B within the movable contact arm supports 54A, 54B as also indicated in phantom. The progressive displacement of the interlock pins and the rectangular slots within the adjacent circuit breaker poles effectively delays the time at which the associated movable contacts with each separate pole will reach their closed position.

Another convenient way to stagger the rotational relationship between the movable contact arms in the separate poles of the circuit breaker is seen by referring back to the movable contact arm assembly 44 depicted in FIG. 4. As described earlier, the movable contact arm 25 interacts with the crossbar assembly 45 by contact between the end 76 of the movable contact arm and the bottom surface 77 of the crossbar assembly. By controllably displacing the surface 77 as indicated in phantom, the position of the movable contact 23 is correspondingly displaced as also indicated in phantom at 23. Accordingly, the bottom surfaces 77 on each of the crossbar assemblies within the separate poles can be incrementally adjusted to correspondingly stagger the times at which the individual contact arms reach their closed positions.

An added benefit achieved by staggering the closing positions of the individual movable contact arms is realized in the closing that occurs between the movable and fixed contacts. The contact springs 55 shown earlier in FIG. 8 tend to compress upon impact between the movable and fixed contacts and hence generate forces opposite to the closing force provided by the operating mechanism springs. The cumulative force of the contact springs within the four poles could possibly prevent the operating mechanism from becoming toggled or overcentered. As well known in the circuit protection industry, the operating mechanism must remain toggled when the circuit breaker contacts are in their closed conditions in order to overcenter and drive the contacts to the open position upon the occurrence of an overcurrent condition. The staggering of the contact arms within the separate poles ensures that the movable contacts within the individual poles will strike against the respective fixed contacts sequentially and not simultaneously with a corresponding decrease in the static friction exerted between the movable and fixed contacts upon impact.

Having thus described our invention, what we claim as new and desire to secure by Letters Patent is:

1. A molded case circuit breaker comprising:

an insulated circuit breaker case and cover;

a stationary and a movable contact within said case said movable contact being arranged at one end of a movable contact arm;

an operating mechanism within said case and arranged for separating said stationary and movable contacts upon overcurrent conditions within a protected circuit;

a handle operator extending outside said cover and arranged for opening and closing said stationary and movable contacts upon quiescent current conditions within said protected circuit;

a pair of extending operating springs connected with said operating mechanism and arranged for rapidly driving said movable contact toward and away from said stationary contact; and an operating spring accelerator interacting with said operating mechanism to provide delayed motion to said movable contact and thereby further extend said operating springs to more rapidly drive said movable contact toward said stationary contact.

2. The circuit breaker of claim 1 wherein said accelerator comprises a lever pivotally-attached a side frame on said operating mechanism.

3. The circuit breaker of claim 2 wherein said lever includes a top end interacting with a part of said side frame and a bottom end interfering with a part of said movable contact arm.

4. The circuit breaker of claim 3 wherein said operating mechanism includes a crossbar supporting said movable contact arm.

5. The circuit breaker of claim 4 including a lobe extending from said crossbar contacting a step formed on said bottom end of said lever.

6. The circuit breaker of claim 3 wherein said top end interacts with said side frame through a compression spring.

* * * * *

UNITED STATES PATENT AND TRADEMARK OFFICE

CERTIFICATE OF CORRECTION

PATENT NO. : 5,200,725

DATED : April 6, 1993

INVENTOR(S) : Arnold et al.

It is certified that error appears in the above-identified patent and that said Letters Patent is hereby corrected as shown below:

IN THE CLAIMS:

Column 8, line 7, Delete "extending" insert --extended--;

Signed and Sealed this

Eighth Day of February, 1994

Bruce Lehman

*Attest:*

BRUCE LEHMAN

*Attesting Officer*

*Commissioner of Patents and Trademarks*